US005326147A

United States Patent [19]

Watson

[11] Patent Number: 5,326,147

[45] Date of Patent: Jul. 5, 1994

[54] DEVICE FOR CARRYING ARTWORKS

[76] Inventor: Nancy H. Watson, 1535 Helen Ct., Merced, Calif. 95340

[21] Appl. No.: 967,826

[22] Filed: Oct. 28, 1992

[51] Int. Cl.[5] ..... B65D 71/00

[52] U.S. Cl. ..... 294/162; 294/137

[58] Field of Search ..... 294/137, 141, 142, 143, 294/159, 162, 165; 248/448, 449, 451, 452, 453

[56] References Cited

U.S. PATENT DOCUMENTS

| | | | |
|---|---|---|---|
| 728,450 | 5/1903 | Everett . | |
| 941,212 | 11/1909 | Tolman . | |
| 1,490,608 | 4/1924 | Gilmour . | |
| 1,576,154 | 3/1926 | Steinman | 248/448 |
| 1,678,353 | 7/1928 | Reach | 294/143 X |
| 2,969,607 | 1/1961 | Grumbacher | 248/448 X |
| 3,008,618 | 11/1961 | Watts et al. | 244/48 |
| 3,281,031 | 10/1966 | Shapiro | 224/45 |
| 4,081,119 | 3/1978 | Messmore | 224/46 R |
| 4,156,498 | 5/1979 | Miller | 294/159 X |
| 4,446,968 | 5/1984 | Bremer | 294/137 X |
| 4,493,504 | 1/1985 | MacHose | 294/143 X |

FOREIGN PATENT DOCUMENTS

| | | | |
|---|---|---|---|
| 127944 | 4/1950 | Sweden | 294/142 |
| 250233 | 5/1948 | Switzerland . | |
| 6709 | 6/1910 | United Kingdom | 294/142 |

*Primary Examiner*—Dean J. Kramer
*Attorney, Agent, or Firm*—Leonard Bloom

[57] ABSTRACT

A device for the carrying of artworks, such as oil paintings, prints and the like for the transportation thereof. A base for receiving the artwork thereon. At least two adjustable clamps are carried by the base for clamping respective opposite edges of the artwork. In this manner, the artwork is secured to the base without either being touched or damaged thereby. Each of the clamps is selectively moveable along respective axes. This permits the precise positioning of the respective clamps to be selectively adjusted to accommodate artworks of various sizes and shapes. Preferably a stationary clamp is also carried by the base.

14 Claims, 5 Drawing Sheets

DEVICE FOR CARRYING ARTWORKS

FIELD OF THE INVENTION

The present invention relates to devices for the carrying of artworks, such as oil paintings, prints and the like.

BACKGROUND OF THE INVENTION

The problem of transporting artworks, such as oil paintings, prints and the like, without causing damage thereto, has been one of long-standing duration. The necessity of minimizing contact with that side of an artwork having the artist's media thereon during the transportation thereof is especially important where the artwork is a still-wet painting. In such cases, contact with the side of the canvas on which the artist's media is disposed, or exposure of that side of the canvas to the elements (or environment) can result in smearing and/or other damage thereto. Such a situation is commonly confronted by, inter alia, landscape painters who must transport their artworks from the field while the media thereon is still wet.

In order to permit the transportation of artworks, especially artworks that are still wet, several differing arrangements have been proposed. For example, U.S. Pat. No. 728,450 issued to Everett and U.S. Pat. No. 941,212 issued to Tolman each disclose clamps for holding a pair of canvases, so that the canvases are maintained facing one another in order to shield them from both inadvertent contact, as well as from the surrounding environment. Unfortunately, neither of these arrangements provide any manner whatsoever for affording the same type of protection when they are utilized to transport only one canvas at a time, which is often the situation encountered by artists. Further, these arrangements may be subject to bending or distortion during the use thereof caused by the stresses and weights to which they are subjected, which could result in the undesired inadvertent contact with and/or exposure of that side of the artwork having the artist's media thereon to the elements which may result in damage thereto.

U.S. Pat. No. 3,281,031 issued to Shapiro discloses a carrier for artist's canvases which possesses greater structural strength. However, that arrangement relies on the use of the framework of the canvases for providing this structural strength. Such a situation places pressures on the framework that could cause bending and/or distortion of the artwork, thereby resulting in damage to the painting. Furthermore, in use, artworks carried with the use of that arrangement are held facing outwardly so that the surfaces thereof that bear the artist's media thereon are exposed to the environment, and are not shielded in any manner whatsoever from being inadvertently contacted.

In an attempt to remedy the problems associated with arrangements such as those discussed above, other arrangements have been disclosed for transporting artworks that shield that surface of the artwork having the artist's media thereon from both the environment and from inadvertent contact therewith. Examples of such arrangements are disclosed in Swiss Letters Patent No. 250,233 issued to Wales and U.S. Pat. No. 4,081,119 issued to Messmore. However, both of these arrangements are complicated. Wales permits the wet surface to contact a second canvas. Messmore can be used only with relatively thin articles which would preclude artworks mounted on frame. Further, like Shapiro '031, these arrangements also place stresses and pressures on the framework of the canvas of the artwork, which can result in bending and/or distortion of painting.

Finally, U.S. Pat. No. 3,008,618 issued to Watts, et al and U.S. Pat. No. 1,490,608 issued to Gilmour each disclose arrangements for holding, respectively, containers, such as cups, having contents, such as liquids or beverages, and an engraving block. However, neither of these arrangements are adaptable for use to secure and hold artworks. Watts cannot be used with flat articles such as an artwork. Gilmour does not prevent the surface of the artwork from contacting the carrier. Furthermore, these arrangements are complicated and can prove expensive.

Accordingly, it can be seen that there remains a need for a device for carrying either one or a pair of artworks, such as paintings, prints and the like, which shields that side (the frontside) of the artwork on which the artist's media is disposed from both inadvertent contact therewith, as well as from the elements. There further remains a need for a device which minimizes contact with that side (the front side) of the artwork on which the artist's media is disposed. Finally, it can be seen that there further remains a need for such a device which is simple, inexpensive to fabricate and easy to use.

SUMMARY OF THE INVENTION

It is a primary object of the present invention to provide a device for the carrying of artworks, such as paintings, prints and the like, which minimizes contact with that side (the front side) of the canvas of the artwork on which the artist's media is disposed, and while shielding that same side of the canvas from the elements (environment).

A further primary object of the present invention is to provide such a device which is capable of affording such protection regardless if it is utilized to carry either one or two artworks simultaneously.

A still further primary object of the present invention is to provide such a device which is simple and inexpensive to fabricate and which is easy to use.

In accordance with the teachings of the present invention, a device is disclosed herein for carrying artworks, such as oil paintings, prints and the like which have a back side and an opposite front side having the artist's media thereon. The device includes a base for receiving the artwork "face down" thereon, so that that side (the front side) of the artwork having the artist's media disposed thereon is shielded by the base from both the elements and from inadvertent contact therewith. Means is provided for spacing the artwork from the base, so that the side (surface) of the artwork (the front side) having the artist's media thereon has no contact with the base. The device further includes adjustable clamps that are carried by the base. The adjustable clamps hold the front side of the artwork by means which contact only the edges of the artwork which are normally covered by framing of the finished artwork, the sides of the artwork and the back side of the artwork (that side which does not have the artist's media thereon). In this manner the artwork is maintained by the clamps in position on the base. Each of the clamps is selectively adjustable, so that the device may be utilized to carry artworks of various sizes and shapes.

Adjustability of the clamps is provided by the clamps being associated with respective guide slots that are formed in the base for each of the clamps provided.

The base has a top, a bottom and two opposite edges. The adjustable clamps are carried by guide slots on the base for clamping respective opposite edges of the artwork. In this manner, that side of the artwork having the artist's media thereon has contact only with the spacing means and will receive only minimal damage from the clamps. Finally, each of the adjustable clamps is selectively moveable along respective axes towards and away from the artwork. In this fashion, the precise positioning of the respective clamps may be selectively adjusted, as desired, to accommodate artworks of various sizes and shapes.

Each of the clamps includes a support block which holds the spacing means on which the front surface of the artwork rests. Each clamp is associated with a respective guide slot, so that the guide slots guide the clamps for the selective movement thereof along the respective axes of the slots. In this manner, the positioning of the clamps along the respective axes of the guide slots may be selectively adjusted as desired, such that the support blocks may be positioned so as to abut opposite edges of the artwork for maintaining the artwork in place on the base. In this manner, the device may accommodate artworks of various sizes and shapes.

Association of each of the blocks with the guide slots for providing the selective adjustability of the clamps is afforded by respective guide bolts that extend through the guide slots and are secured, on one end thereof, to the support block.

Each of the clamps further includes a respective moveable clamping flange that is secured to and carried by the support block thereof, so as to be at least partly rotatable (pivotable) relative thereto. In this fashion, with the respective clamps positioned abutting the artwork, the clamping flanges thereof may be at least partly rotated (pivoted) into a position over the back side of the artwork. These clamping flanges may then be secured in position, thereby maintaining the artwork in place on the base for being carried by the device.

In further accordance with the teachings of the present invention, the device is adapted for simultaneously carrying two such artworks, if such is desired. In this embodiment, the base includes a pair of opposite sides and the stationary clamps are "double-headed" clamps having one head comprised of a support block and a clamping flange secured on each end of a guide bolt, so as to be disposed on each side of the base. In this manner, two artworks may be simultaneously carried by the device while the side (the front side) of the artwork having the artist's media thereon is shielded from both the environment and inadvertent contact therewith, thereby minimizing damage thereto.

These and other objects and advantages of the present invention will become readily apparent from a reading of the following description, taken in conjunction with the drawings.

BRIEF DESCRIPTION OF THE DRAWINGS

FIG. 6 illustrates a user of the device placing the artwork on the base of the device abutting the stationary clamp (cleat), so that the surface (the front side) of the artwork bearing the artist's media is shielded from the environment and from inadvertent contact therewith.

FIG. 7 illustrates the rotation of the clamping flanges of the clamps, so as to contact only the back side of the artwork, and maintain the artwork on the base, so that it cannot become dislodged therefrom.

FIG. 8 illustrates the user securing the clamping flanges in place, such that the device is readed for use.

FIG. 9 illustrates the device in use with the user gripping the handle thereof to safely carry (transport) the artworks secured thereto.

DESCRIPTION OF PREFERRED EMBODIMENTS

Figure 1:
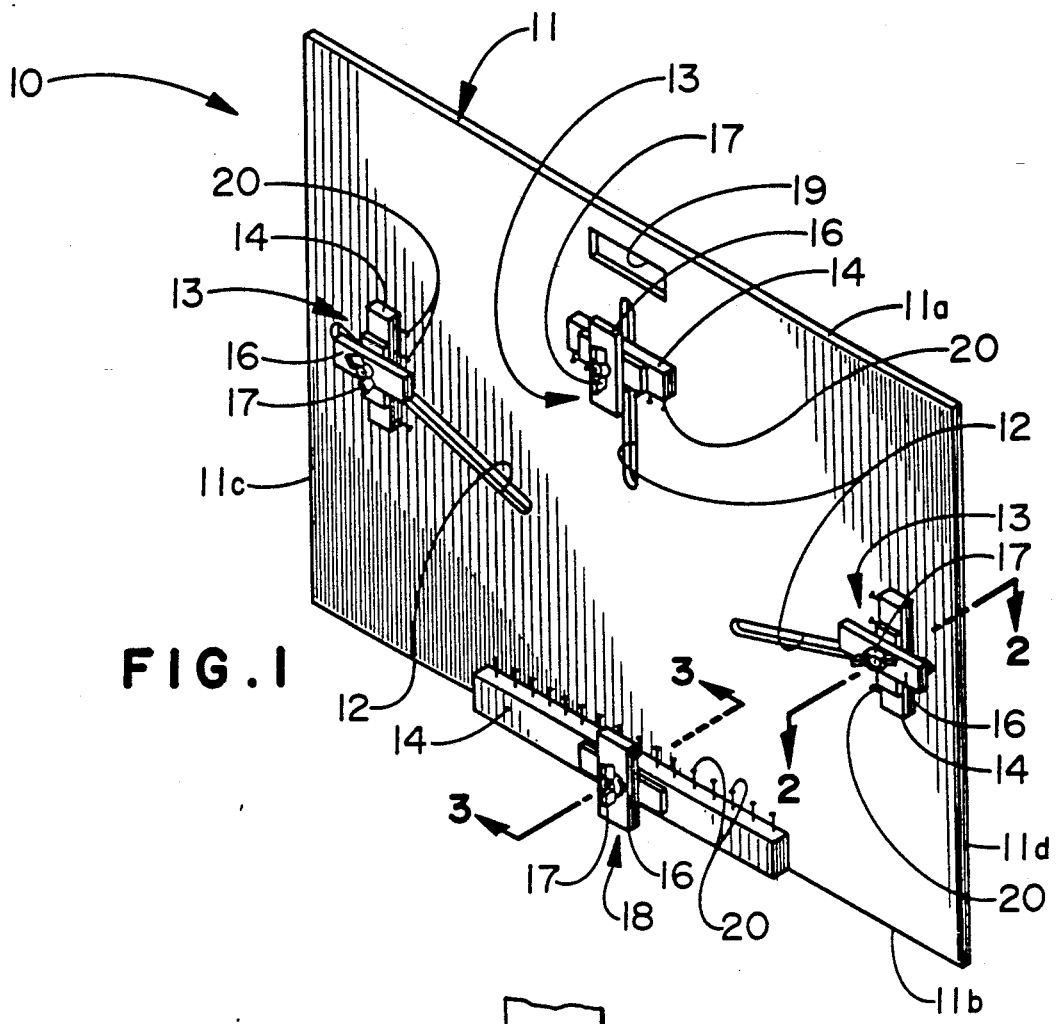
FIG. 1 is a perspective view of a preferred embodiment of the device of the present invention, wherein three adjustable (moveable) clamps are provided.

Referring now to the drawings and, in particular, to FIGS. 1–5, the preferred embodiments of the device 10 of the present invention are now discussed. As was noted above, the device 10 is intended for use in carrying canvas-mounted artworks 1, such as paintings, prints and the like, having edges, a top, a bottom, a back side and a front side 3 on which the artist's media is disposed. The edges of the artwork 1 are normally mounted on a stretcher 2 which extends about the entire artwork. The base 11 is larger than the artwork to provide protection to the artwork.

The device 10 includes a base 11 for receiving the artwork 1 thereon, front side 3 face-down. Positioned thusly on the base 11, that side (surface) 3 of the canvas having the artist's media thereon is shielded from both the elements (the environment) and from inadvertent contact therewith. The front side 3 is separated from contact with the surface of the base 11 by the presence of a means 20 for spacing the front side 3 of the artwork from the base 11, as shall be discussed at greater length below.

The base 11 has a top 11*a*, a bottom 11*b* and a pair of opposite edges (or sides) 11*c* and 11*d*. A plurality of (close-ended) guide slots 12 are formed through the base 11. These guide slots 12 are formed, so as to extend along respective axes, for reasons that shall be discussed below. Preferably, the guide slots 12 are all oriented so as to extend from near the respective edges 11*c* and 11*d* or the top 11*a*, being angled downwardly towards the bottom 11*b* of the base 11. In this regard, it is noted that the guide slots 12 formed in the opposite edges 11*c* and 11*d* are further oriented so as to extend towards the middle (midline or vertical axis) of the base 11.

The device 10 further includes moveable or adjustable clamps 13 that are carried by the base 11 (near the opposite edges or sides 11*c* and 11*d*, and, if desired, the top 11*a*). These clamps 13 are provided for clamping the edges (including the opposite edges and the stretcher 2) of the back side of the artwork 1, so that the artwork 1 is maintained in position on the base 11. In this manner, the front side 3 of the artwork 1 itself will not be touched or damaged by the adjustable clamps 13. The positioning of each of these clamps 13 is moveable, so as to be selectively adjustable, as shall be discussed at length below, so that the device 10 may be utilized to carry artworks 1 of various shapes and sizes.

As will be discussed below, each clamp 13 further includes means 20 for spacing the front side 3 of the artwork 1 from the base 11.

Figure 2:
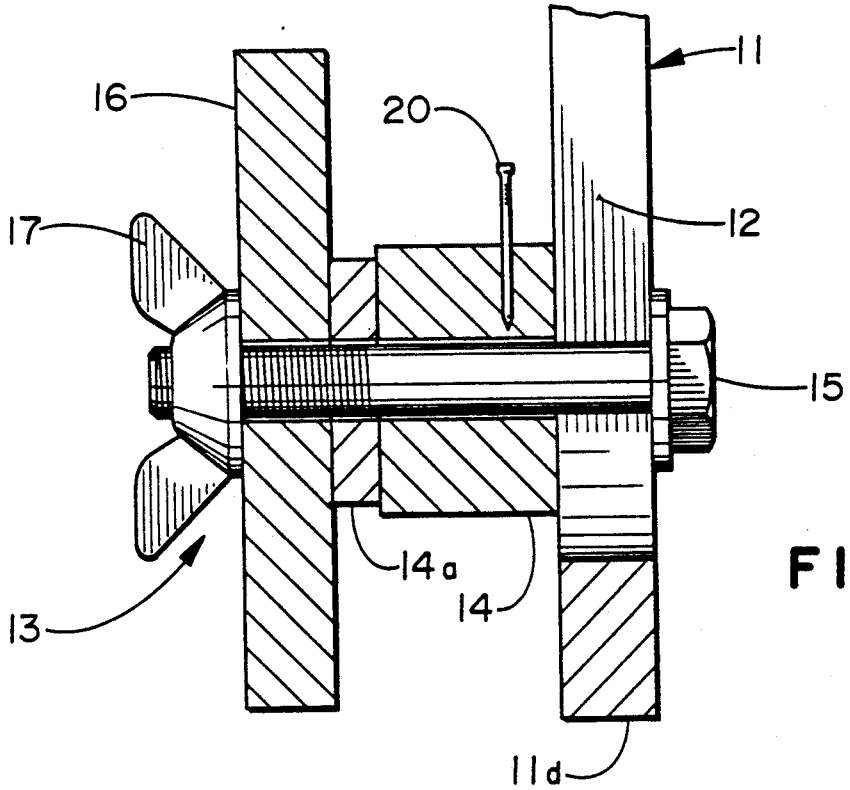
FIG. 2 is a cross-section view taken along lines 2—2 of FIG. 1 illustrating the structure of the adjustable clamp of the device of the present invention.
Figure 3:
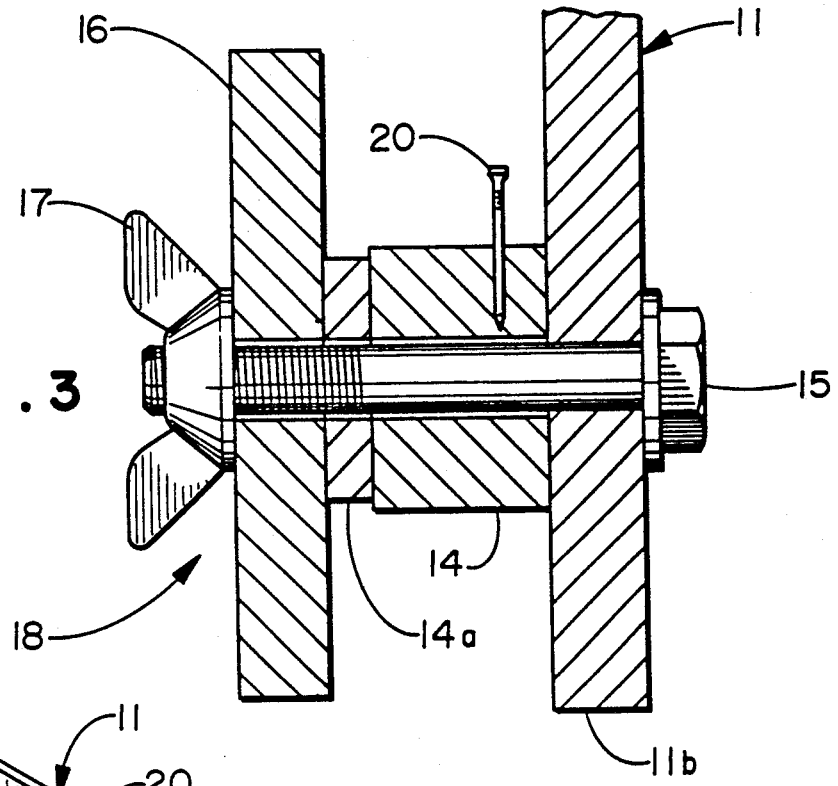
FIG. 3 is a cross-section view taken along lines 3—3 of FIG. 1 illustrating the structure of the stationary clamp of the device of the present invention.
Figure 4:
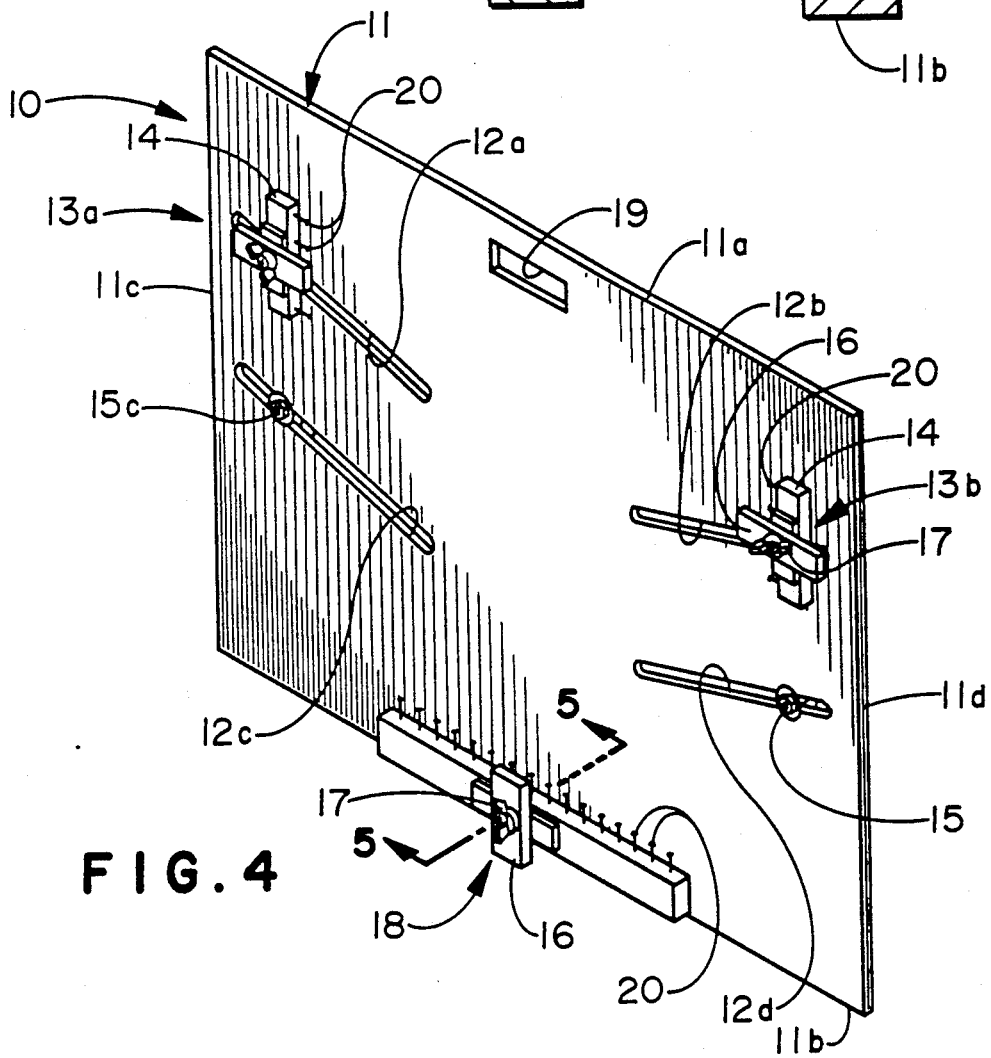
FIG. 4 is a perspective view of another preferred embodiment of the present invention, wherein four adjustable and two stationary clamps are provided for carrying two artworks simultaneously.

The number and positioning of the clamps 13 and the guide slots 12 to be provided may be varied as desired. However, it is noted that the device will be comprised of, at least, one respective guide slot 12 formed near each of the opposite edges 11*c* and 11*d* of the base and at least one respective clamp 13 that is carried near each of the opposite edges 11*c* and 11*d* of the base 11. As seen in FIGS. 1–3, in one preferred embodiment, three such guide slots 12 and clamps 13 are provided, one each near the opposite edges 11*c* and 11*d* of the base 11 and the third on the top 11*a* of the base 11. As seen in FIG. 4, in another preferred embodiment, four such guide slots 12 and clamps 13 are provided, two each near the opposite edges 11*c* and 11*d* of the base 11 which are substantially parallel to one another.

With particular reference now to FIG. 2, each of the adjustable clamps 13 includes a respective support block 14. Each of these blocks 14 is associated with a respective guide slot 12 for the selective movement of the clamps 13 along the respective axes of the guide slots 12. In this fashion, the precise positioning of the clamps 13 along the respective axes of the guide slots 12 may be selectively adjusted as desired, such that the support blocks 14 may be positioned abutting the edges of the artwork 1 for aiding in maintaining the artwork 1 in place on the base 11. Such abutting maintains the artwork 1 in place by preventing lateral slipping of the artwork 1 on the base 11.

Association of each of the blocks 14 with the guide slots 12 for the adjustability of the clamps 13 is provided by respective guide bolts 15. The guide bolts 15 are positioned extending from one side of the base 11, through respective guide slots 12, to the other side of the base 11, where the one end of the guide bolt 15 is secured to a respective support block 14. In this fashion, the positioning of the guide bolt 15 through the guide slot 12 acts to guide the movement of the moveable clamp 13 for the selective adjustment of the clamps along the respective axes of the slots 12.

Each of the moveable, adjustable clamps 13 further includes a respective moveable clamping flange 16. Flanges 16 are secured to and carried by the respective support blocks 14, so as to be at least partly rotatable (pivotal) relative thereto. Preferably, this is achieved by the clamping flanges 16 also being secured to the one end of the guide bolt 15. In this fashion, when the respective support blocks 14 are positioned abutting the edges of the artwork 1, the clamping flanges 16 may be at least partly rotated (pivoted) over the back side 2 of the artwork 1 and secured in position by the use of wing nuts 17, nuts or any other suitable means. Positioned thusly, the artwork 1 is maintained (clamped) between the flange 16 and the means 20 for spacing the artwork 1 from the base 11 for being carried by the device 10. Thus, it can be seen that the proper positioning of the flanges 16 over the back side 2 of the artwork 1 maintains the artwork 1 in place on the base 11 for being carried by the device 10.

As can be further seen in FIG. 3, each adjustable clamp 13 may also include a spacer or shim 14*a* that is disposed between the support block and the flange 16. Preferably, this spacer or shim 14*a* is fabricated from foam or some other compressible material. It is noted that, while the provision of this spacer or shim 14*a* is not necessary, it is preferred in that it facilitates the tight clamping and holding of the artwork 1 on the device 10 and allows for variations in the thickness of the artwork being carried.

With particular reference now to FIG. 3, the device 10 is seen to further include at least one stationary clamp (cleat) 18. In one preferred embodiment, two such stationary clamps 18 are provided. Stationary clamps 18 are positioned along the bottom 11*b* of the base 11. These stationary clamps 18 may be as long as desired. As can perhaps be best seen in FIG. 3, each stationary clamp 18 further has a thickness. This feature permits the bottom of the artwork 1 to be received and supported on the stationary clamp(s) 18 when the artwork 1 is disposed on the base 11 for placement and prevention of slippage of the artwork 1.

Preferably, the stationary clamp(s) 18 (like the adjustable clamps 13 discussed above) may also include support blocks 14, spacers 14*a* and clamping flange(s) 16 which are at least partly rotatable over the bottom of the back side 2 of the artwork 1 for holding the artwork 1 thereof in place on the base 11.

As seen in FIGS. 2 and 3, the moveable clamps 13 and the stationary clamps 18 include means 20 for spacing the artwork 1 from the base 11. Preferably, this means 20 is comprised of spaced pins or brads 20 which are carried by the support blocks 14 of the clamps 13, 18. The pins 20 contact the front side 3 of the artwork 1 only where the finished artwork 1 is normally covered by a frame. The pins do not contact unsupported canvas so that damage to the canvas (and the artwork) is prevented. Such pins 20, while contacting the front side 3 of the artwork 1 on which the artist's media is disposed, nonetheless provides minimal contact therewith, and certainly less than that which would occur if the front side 3 of the artwork 1 were permitted to contact the base 11.

Finally, if desired, the base 11 may have a handle 19 formed in the top 11*a* thereof. This handle 19 permits the device 10 to be gripped for carrying the device 10 without either touching or damaging the artwork 1. Preferably, this handle 19 is in the form of a slot that is formed in the top 11*a* of the base 11.

Thus, it can be seen that the device 10 of the present invention is capable, if desired, of holding a single artwork 1 for the transport thereof, so that the surface (the front side) 3 having the artist's media thereon is shielded from both the elements and from inadvertent contact therewith.

Figure 5:
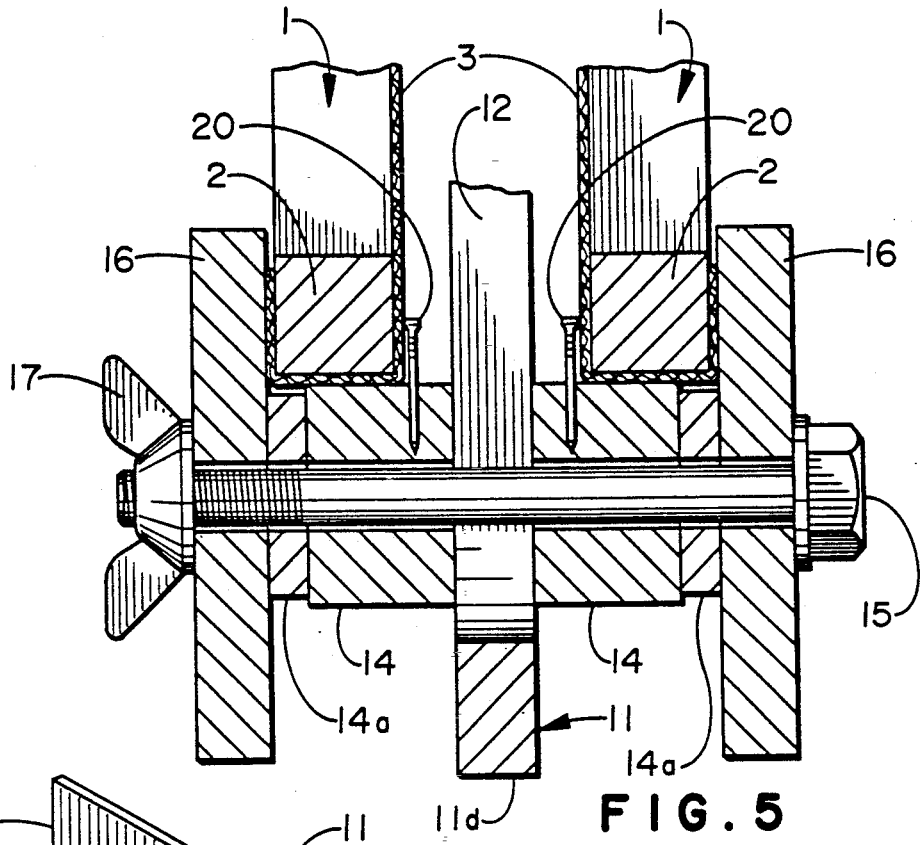
FIG. 5 is a cross-section view taken along the lines 5—5 of FIG. 4.

Referring now to FIGS. 4 and 5, in accordance with the teachings of the present invention, it is especially preferred herein to provide a device 10 that is capable of simultaneously carrying two such artworks 1, if that is desired. Such a device 10 would be identical to those discussed above relative to FIGS. 1–4, except that the moveable clamps 13 (and the stationary clamps) would be positioned on both of the appropriate sides of the base 11. Preferably, this is achieved by the stationary clamp (s) 18 being a "double-headed" clamp. That is to say, that the stationary clamp 18 would include a respective support block 14, means 20 and clamping flange 16 secured on each end of the guide bolt(s) 15, so that one each of the support blocks 14 and clamping flanges 16 of each "double-headed" clamp 13 is disposed on the opposite sides of the base 11. The base 11 further is preferably provided with at least four guide slots 12. Two of the guide slots 12*a* are disposed near one edge 11*c* of the base 11 and two of the guide slots 12*b* are disposed near the opposite edge 11*d* of the base 11. All the guide slots are angled downwardly toward the bottom 11*b* of the base. An adjustable clamp 13 is disposed in each guide slot. Two of the adjustable clamps 13*a*, 13*b* are disposed on one side of the base in guide slots 12*a*, 12*b* on opposite edges of the base to retain one artwork on said side of the base. The other two adjustable clamps (shown only by the bolts 15*c*, 15*d*) are disposed in the remaining guide slots 12*c*, 12*d* on opposite edges of the base 11 and on the opposite side of the base 11. Thus, the adjustable clamps 13 may each be moved independently to hold an artwork of a desired size. In this fashion, respective artworks 1 of the same or differing sizes may be disposed on and carried by each of the opposite sides of the base 11.

Having discussed the structure of the device 10 of the present invention, with reference now to FIGS. 6–9, the operation of the device 10 to carry artworks 1 is now discussed.

Figure 6:
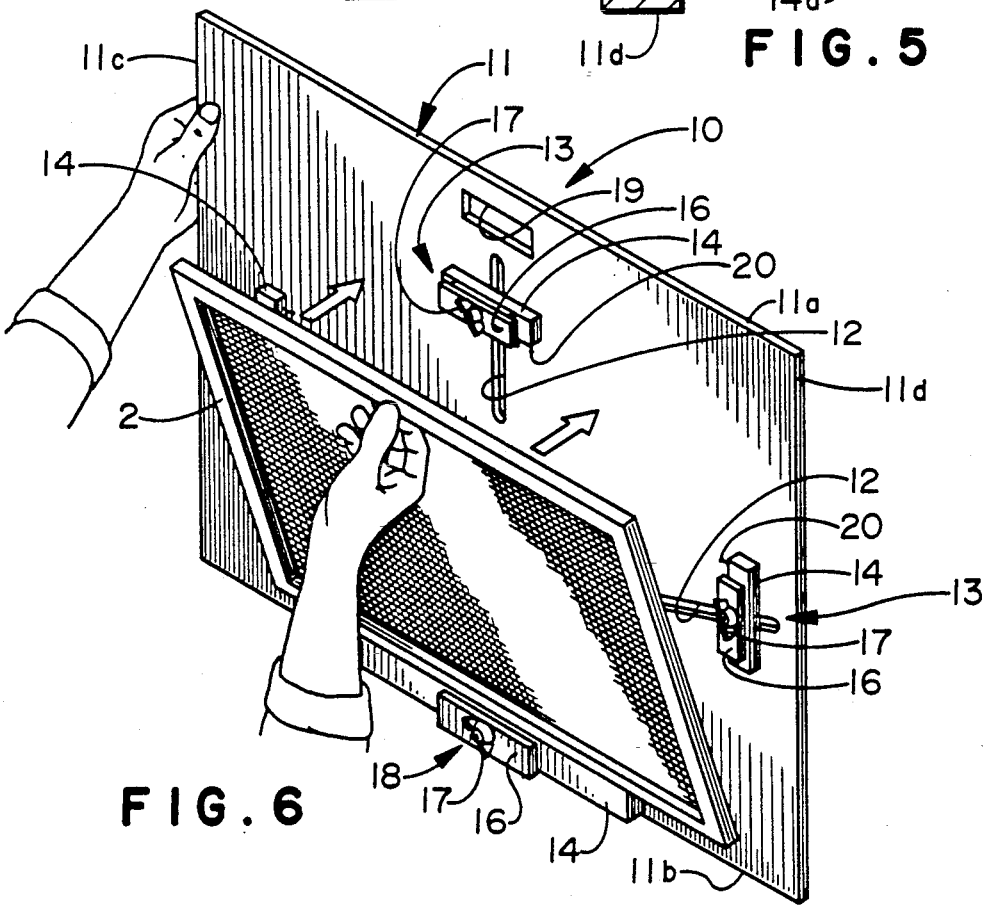
FIGS. 6–9 illustrate the use of the device of the present invention, as embodied in FIGS. 1–3.

First, the user of the device 10 places the artwork(s), to be carried, on (opposite sides of) the base 11. In this respect, as was noted above, each of the artworks 1 is disposed "face-down" against the means 20 on the stationary clamp 18 and towards the base 11, so that the surface (the front side) of the artwork 1 bearing the artist's media thereon is shielded from both the environment, as well as from inadvertent contact therewith. Further, in this respect, the artwork(s) 1 are positioned, so as to abut the stationary clamp(s) 18, so that the artwork cannot slip or move downwardly during the carrying thereof (FIG. 6).

Once positioned, the user moves the clamps 13 along the respective axes towards the edges of the artwork 1, so that the support blocks 14 abut the edges of the artwork 1 with the means 20 positioned between the front side 3 of the artwork 1 and the base 11. In this respect, the artwork 1 cannot move sideways during the carrying thereof. Further, in this fashion, the pins 20 prevent the front side 3 of the artwork 1 from contacting the base 11.

Figure 7:
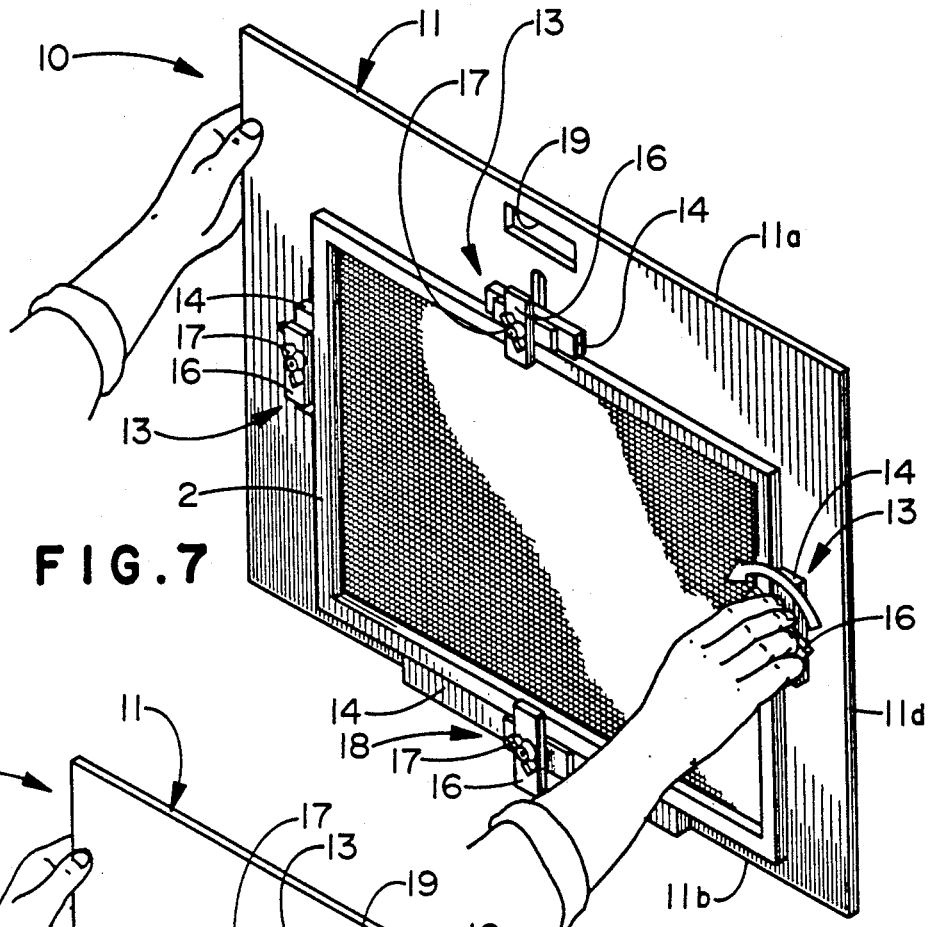
Figure 8:
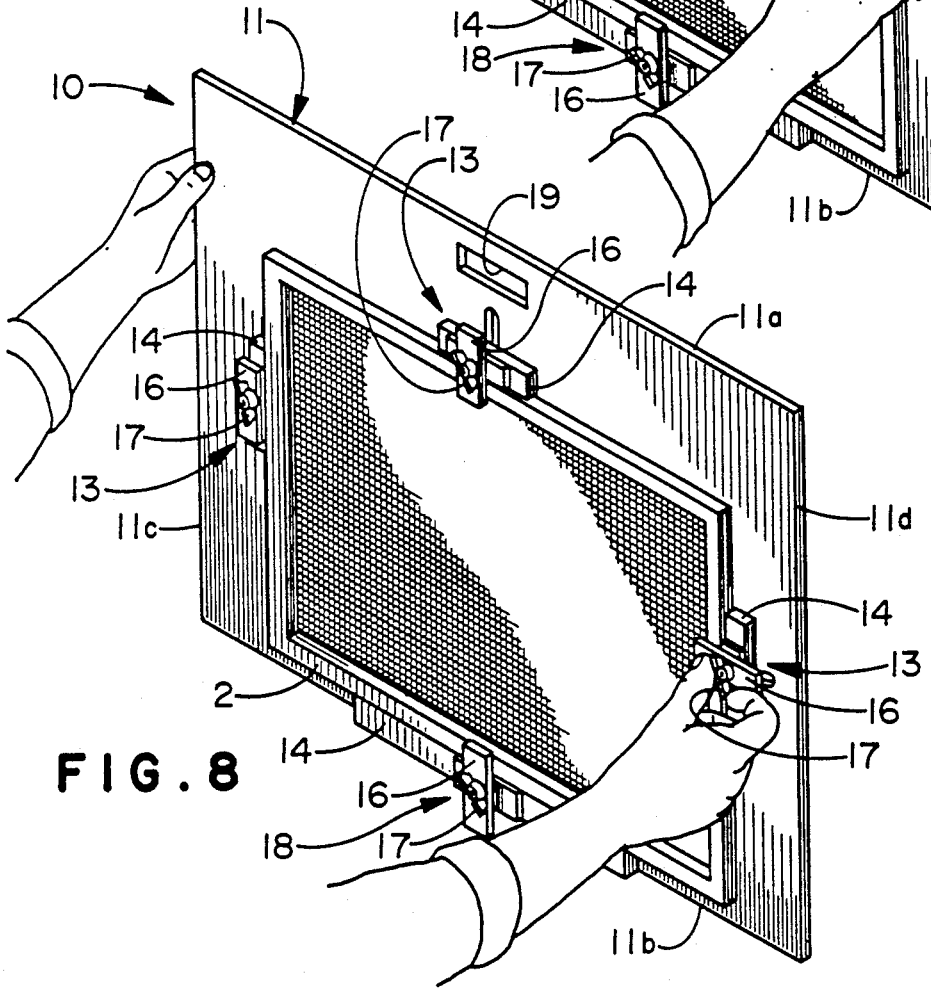

With the support blocks 14 positioned abutting the artwork ( s ) 1, the user then may rotate (pivot) the respective clamping flanges 16 of the moveable clamps 13 (and the flanges 16 of the stationary clamps 18, if such is provided), so that the clamping flanges 16 overlie the back side 2 of the artwork 1 (FIG. 7). Thus positioned, the flanges 16 may then be secured in place by, for example, tightening of wing nuts carried on the bolts 15 of each clamp 13 (FIG. 8). In this respect, the front side 3 of the artwork 1 is held facing the base 1 during the carrying thereof.

Figure 9:
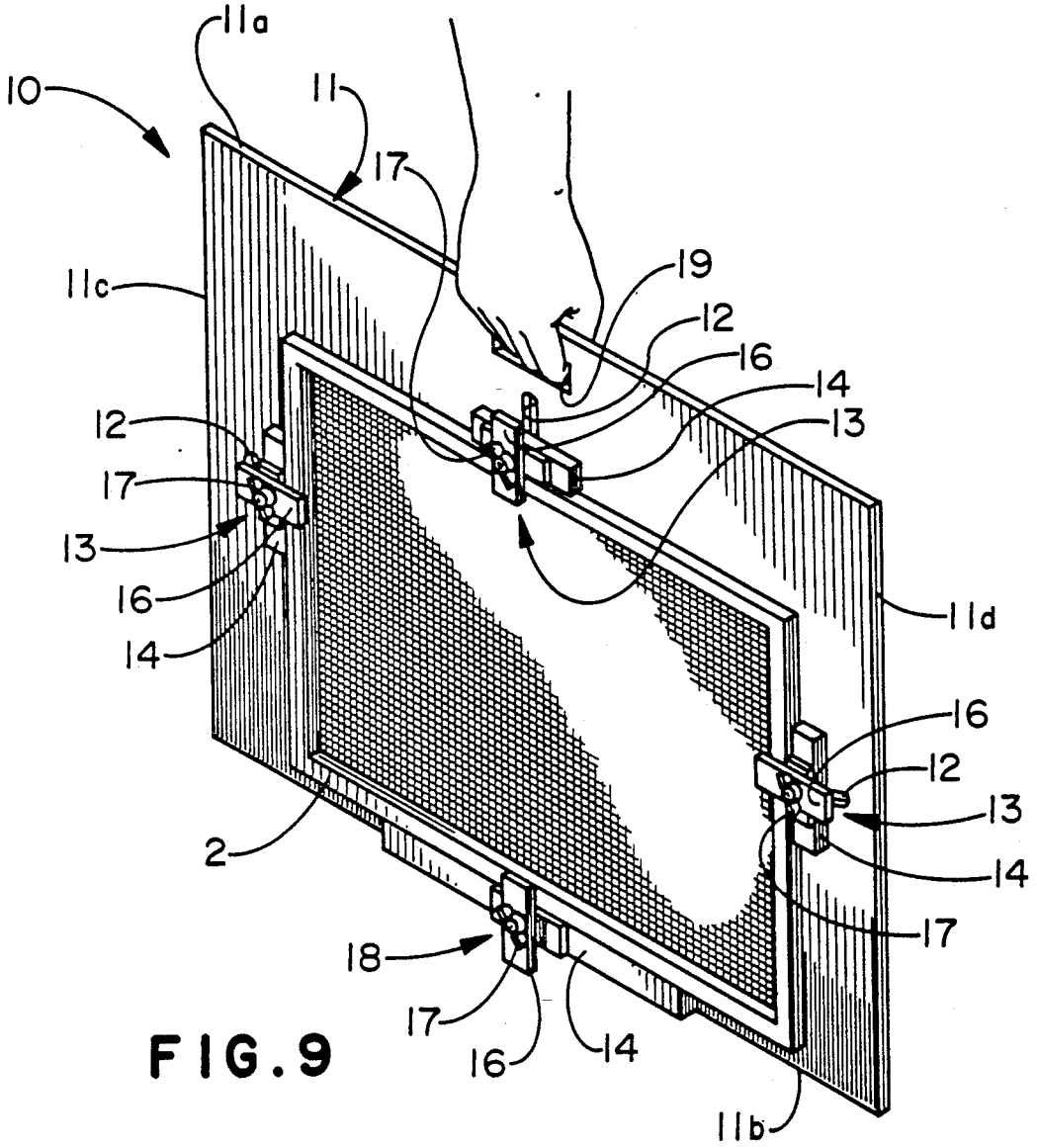

Thus, it can be seen that with the moveable clamps 13 positioned as described above, artwork(s) 1 are secured on the base 11 in such a position that the surface (front side) 3 of the artwork 1 bearing the artist's media thereon is shielded from both the environment and from inadvertent contact which may cause damage thereto. Thus secured, the user may then simply grasp or grip the handle 19 thereof for carrying (transporting) the artwork(s) 1 (FIG. 9).

Obviously, many modifications may be made without departing from the basic spirit of the present invention. For example, variations in the number and placement of the slots and the clamps may be provided. Accordingly, it will be appreciated by those skilled in the art, that, within the scope of the appended claims, the invention may be practiced other than has been specifically described herein.

What is claimed is:

1. A device for carrying artworks, oil paintings and prints, the artwork including edges, a back side and an opposite front side having the artist's media thereon, the device comprising: a base for receiving the artwork thereon, the base having a top, a bottom and two opposite edges, at least two adjustable clamps carried by the base for clamping respective opposite edges of the artwork, means on the adjustable clamps for spacing the front side of the artwork from the base, so that the front side of the artwork having the artist's media thereon is secured to the device with minimal damage thereto, each of the adjustable clamps being selectively moveable along respective axes, whereby the precise positioning of the respective clamps may be selectively adjusted to accommodate artworks of various sizes and shapes, wherein each of the adjustable clamps include a respective moveable clamping flange, so as to be at least partly rotatable relative thereto, whereby with the respective clamps positioned as desired the clamping flange thereof may be at least partly rotated over the opposite edges of the back side of the artwork, such that the artwork is secured to the base for being carried by the device.

2. A device for carrying artworks, oil painting and prints, the artwork including edges, a back side and an opposite front side having the artist's media thereon, the device comprising: a base for receiving the artwork thereon, the base having a top, a bottom and two opposite edges, at least two adjustable clamps carried by the base for clamping respective opposite edges of the artwork, means on the adjustable clamps for spacing the front side of the artwork from the base, so that the front side of the artwork having the artist's media thereon is secured to the device with minimal damage thereto, each of the adjustable clamps being selectively moveable along respective axes, whereby the precise positioning of the respective clamps may be selectively adjusted to accommodate artworks of various sizes and shapes, wherein each of the adjustable clamps include a respective moveable clamping flange, so as to be at least partly rotatable relative thereto, whereby with the respective clamps positioned as desired the clamping flange thereof may be at least partly rotated over the opposite edges of the back side of the artwork, such that the artwork is secured to the base for being carried by the device, wherein each of the adjustable clamps further includes a respective support block, the clamping flange of each clamp being carried by the support block thereof, and each of the support blocks being selectively movable along the respective axes, such that the support blocks may be positioned abutting the opposite edges of the artwork for further maintaining the art work in place on the base.

3. A device for carrying artworks, oil painting and prints, the artwork including edges, a back side and an opposite front side having the artist's media thereon, the device comprising: a base for receiving the artwork thereon, the base having a top, a bottom and two opposite edges, at least two adjustable clamps carried by the base for clamping respective opposite edges of the artwork, means on the adjustable clamps for spacing the front side of the artwork from the base, so that the front side of the artwork having the artist's media thereon is secured to the device with minimal damage thereto, each of the adjustable clamps being selectively moveable along respective axes, whereby the precise positioning of the respective clamps may be selectively adjusted to accommodate artworks of various sizes and shapes, wherein the base has a respective guide slot formed therein for each of the adjustable clamps provided, each of the guide slots being formed extending along the respective axes, and wherein each of the adjustable clamps further includes a respective support block associated with each of the guide slots, so that the guide slots guide the support blocks of the respective clamps associated therewith for selectively moving the clamps along the respective axes thereof, so as to selectively adjust the positioning of the clamps along the respective axes of the guide slots, as desired, to accommodate artworks of various sizes and shapes, such that the support blocks may be positioned abutting opposite edges of the artwork for maintaining the artwork in place on the base, and wherein each of the clamps include a respective moveable clamping flange secured to and carried by the support block thereof, so as to be at least partly rotatable relative thereto, whereby with the respective clamps positioned as desired the clamping flange may be at least partly rotated over the back side of the artwork, such that the artwork is secured to the base for being carried by the device.

4. A device for carrying artworks, oil painting and prints, the artwork including edges, a back side and an opposite front side having the artist's media thereon, the device comprising: a base for receiving the artwork thereon, the base having a top, a bottom and two opposite edges, at least two adjustable clamps carried by the base for clamping respective opposite edges of the artwork, means on the adjustable clamps for spacing the front side of the artwork from the base, so that the front side of the artwork having the artist's media thereon is secured to the device with minimal damage thereto, each of the adjustable clamps being selectively moveable along respective axes, whereby the precise positioning of the respective clamps may be selectively adjusted to accommodate artworks of various sizes and shapes, wherein the base has a respective guide slot formed therein for each of the adjustable clamps provided, each of the guide slots being formed extending along the respective axes, and wherein each of the adjustable clamps further includes a respective support block associated with each of the guide slots, so that the guide slots guide the support blocks of the respective clamps associated therewith for selectively moving the clamps along the respective axes thereof, so as to selectively adjust the positioning of the clamps along the respective axes of the guide slots, as desired, to accommodate artworks of various sizes and shapes, such that the support blocks may be positioned abutting opposite edges of the artwork for maintaining the artwork in place of the base, and wherein each of the clamps include a respective moveable clamping flange secured to and carried by the support block thereof, so as to be at least partly rotatable relative thereto, whereby with the respective clamps positioned as desired the clamping flange may be at least partly rotated over the back side of the artwork, such that the artwork is secured to the base for being carried by the device, wherein each of the adjustable clamps further includes a guide bolt being received through the support block, clamping flange and guide slot therefor, whereby the guide bolt of each of the clamps extends through the guide slot associated therewith, whereby each of the adjustable clamps is guided by the guide bolt through the guide slot for the selective adjustment of each of the clamps along the respective axes of the guide slots.

5. A device for carrying artworks, oil painting and prints, the artwork including edges, a back side and an opposite front side having the artist's media thereon, the device comprising: a base for receiving the artwork thereon, the base having a top, a bottom and two opposite edges, at least two adjustable clamps carried by the base for clamping respective opposite edges of the artwork, means on the adjustable clamps for spacing the front side of the artwork from the base, so that the front side of the artwork having the artist's media thereon is secured to the device with minimal damage thereto, each of the adjustable clamps being selectively moveable along respective axes, whereby the precise positioning of the respective clamps may be selectively adjusted to accommodate artworks of various sizes and shapes, further comprised of at least one stationary clamp positioned along the bottom of the base, said stationary clamp having a thickness, whereby the artwork may be received and supported thereon, and wherein each of the stationary clamps includes a respective moveable clamping flange, so as to be at least partly rotatable relative thereto, whereby with the artwork positioned on the stationary clamp, the clamping flange thereof may be at least partly rotated over the backside of the artwork, such that the artwork is secured to the base for being carried by the device.

6. A device for carrying artworks, oil painting and prints, the artwork including edges, a back side and an opposite front side having the artist's media thereon, the device comprising: a base for receiving the artwork thereon, the base having a top, a bottom and two opposite edges, at least two adjustable clamps carried by the base for clamping respective opposite edges of the artwork, means on the adjustable clamps for spacing the front side of the artwork from the base, so that the front side of the artwork having the artist's media thereon is secured to the device with minimal damage thereto, each of the adjustable clamps being selectively moveable along respective axes, whereby the precise positioning of the respective clamps may be selectively adjusted to accommodate artworks of various sizes and shapes, wherein four guide slots and four adjustable clamps are provided, two of said guide slots and adjustable clamps being disposed near each of the opposite edges of the base, said guide slots being angled downwardly towards the bottom of the base.

7. A device for carrying artworks, oil painting and prints, the artwork including edges, a back side and an opposite front side having the artist's media thereon, the device comprising: a base for receiving the artwork thereon, the base having a top, a bottom and two opposite edges, at least two adjustable clamps carried by the base for clamping respective opposite edges of the artwork, means on the adjustable clamps for spacing the front side of the artwork from the base, so that the front side of the artwork having the artist's media thereon is secured to the device with minimal damage thereto, each of the adjustable clamps being selectively moveable along respective axes, whereby the precise positioning of the respective clamps may be selectively adjusted to accommodate artworks of various sizes and shapes, wherein three guide slots and three adjustable clamps are provided, one of said guide slots and adjustable clamps being disposed near each of the opposite edges of the base and the remaining guide slot and adjustable clamp being disposed near the top of the base.

8. A device for carrying artworks, oil painting and prints, the artwork including edges, a back side and an opposite front side having the artist's media thereon, the device comprising: a base for receiving the artwork thereon, the base having a top, a bottom and two opposite edges, at least two adjustable clamps carried by the base for clamping respective opposite edges of the artwork, means on the adjustable clamps for spacing the front side of the artwork from the base, so that the front side of the artwork having the artist's media thereon is secured to the device with minimal damage thereto, each of the adjustable clamps being selectively moveable along respective axes, whereby the precise positioning of the respective clamps may be selectively adjusted to accommodate artworks of various sizes and shapes, wherein three guide slots and three adjustable clamps are provided, one of said guide slots and adjustable clamps being disposed near each of the opposite edges of the base and the remaining guide slot and adjustable clamp being disposed near the top of the base, and wherein each guide slot is angled downwardly towards the bottom of the base.

9. A device for carrying artworks, oil painting and prints, the artwork including edges, a back side and an opposite front side having the artist's media thereon, the device comprising: a base for receiving the artwork thereon, the base having a top, a bottom and two opposite edges, at least two adjustable clamps carried by the base for clamping respective opposite edges of the artwork, means on the adjustable clamps for spacing the front side of the artwork from the base, so that the front side of the artwork having the artist's media thereon is secured to the device with minimal damage thereto, each of the adjustable clamps being selectively moveable along respective axes, whereby the precise positioning of the respective clamps may be selectively adjusted to accommodate artworks of various sizes and shapes, wherein the means for spacing the front side of the artwork from the base is a plurality of spaced-apart pins disposed on the clamps such that the spaced-apart pins contact the front side of the artwork only about the edges of the artwork.

10. A device for carrying artworks, oil painting and prints, the artwork including edges, a back side and an opposite front side having the artist's media thereon, the device comprising: a base for receiving the artwork thereon, the base having a top, a bottom and two opposite edges, at least two adjustable clamps carried by the base for clamping respective opposite edges of the artwork, means on the adjustable clamps for spacing the front side of the artwork from the base, so that the front side of the artwork having the artist's media thereon is secured to the device with minimal damage thereto, each of the adjustable clamps being selectively moveable along respective axes, whereby the precise positioning of the respective clamps may be selectively adjusted to accommodate artworks of various sizes and shapes, wherein the base further includes a pair of opposite sides and four guide slots, two of said guide slots being disposed near one edge of the base and two of said guides being disposed near the opposite edge of the base, said guide slots being angled downwardly towards the bottom of the base, an adjustable clamp being disposed in each guide slot, two of said adjustable clamps being disposed on the one side of the base in guide slots on opposite edges of the base and two of said adjustable clamps being disposed on the opposite side of the base in guide slots on opposite edges of the base, whereby a first artwork of one size may be carried on one side of the base and a second artwork of another size may be simultaneously carried on the opposite side of the base.

11. A device for carrying artworks, oil painting and prints, the artwork including edges, a back side and an opposite front side having the artist's media thereon, the device comprising: a base for receiving the artwork thereon, the base having a top, a bottom and two opposite edges, at least two adjustable clamps carried by the base for clamping respective opposite edges of the artwork, means on the adjustable clamps for spacing the front side of the artwork from the base, so that the front side of the artwork having the artist's media thereon is secured to the device with minimal damage thereto, each of the adjustable clamps being selectively moveable along respective axes, whereby the precise positioning of the respective clamps may be selectively adjusted to accommodate artworks of various sizes and shapes, wherein the base further includes a pair of opposite sides and four guide slots, two of said guide slots being disposed near one edge of the base and two of said guides being disposed near the opposite edge of the base, said guide slots being angled downwardly towards the bottom of the base, an adjustable clamp being disposed in each guide slot, two of said adjustable clamps being disposed on one side of the base in guide slots on opposite edges of the base and two of said adjustable clamps being disposed on the opposite side of the base in guide slots on opposite edges of the base, whereby a first artwork of one size may be carried on one side of the base and a second artwork of another size may be simultaneously carried on the opposite side of the base, wherein each of the adjustable clamps further includes a respective support block associated with each of the guide slots, so that the guide slots guide the support blocks of the respective clamps associated therewith for selectively moving the clamps along the respective axes thereof, so as to selectively adjust the positioning of the clamps along the respective axes of the guide slots, as desired, to accommodate artworks of various sizes and shapes, such that the support blocks may be positioned abutting opposite edges of the artwork for maintaining the artwork in place on the base, and wherein each of the clamps include a respective moveable clamping flange secured to and carried by the support block thereof, so as to be at least partly rotatable relative thereto, whereby with the respective clamps positioned as desired the clamping flange may be at least partly rotated over the back side of the artwork, such that the artwork is secured to the base for being carried by the device.

12. A device for carrying artworks, oil painting and prints, the artwork including edges, a back side and an opposite front side having the artist's media thereon, the device comprising: a base for receiving the artwork thereon, the base having a top, a bottom and two opposite edges, at least two adjustable clamps carried by the base for clamping respective opposite edges of the artwork, means on the adjustable clamps for spacing the front side of the artwork from the base, so that the front side of the artwork having the artist's media thereon is secured to the device with minimal damage thereto, each of the adjustable clamps being selectively moveable along respective axes, whereby the precise positioning of the respective clamps may be selectively adjusted to accommodate artworks of various sizes and shapes, wherein the base further includes a pair of opposite sides and four guide slots, two of said guide slots being disposed near one edge of the base and two of said guides being disposed near the opposite edge of the base, said guide slots being angled downwardly towards the bottom of the base, an adjustable clamp being disposed in each guide slot, two of said adjustable clamps being disposed on the one side of the base in guide slots on opposite edges of the base and two of said adjustable clamps being disposed on the opposite side of the base in guide slots on opposite edges of the base, whereby a first artwork of one size may be carried on one side of the base and a second artwork of another size may be simultaneously carried on the opposite side of the base, and further comprised of at least one stationary clamp positioned along the bottom of each of the opposite sides of the base for providing placement and preventing slippage of the artworks.

13. The device of claim 12, wherein each stationary clamp further has a thickness, whereby the artworks may be received and supported thereon when disposed on the opposite sides of the base and wherein each of the stationary clamps includes a respective moveable clamping flange, so as to be at least partly rotatable relative thereto, whereby with the artwork positioned on the stationary clamp, the clamping flanges thereof may be at least partly rotated over the backside of the artworks, such that the artworks are secured to the base for being carried by the device.

14. A device for carrying artworks, oil paintings and prints, the artwork having edges, a front side and a back side, the device comprising: a base for receiving the artwork thereon, the base having a top, a bottom and two opposite edges, means for spacing the front side of the artwork from the base, at least two adjustable clamps carried near opposite edges of the base for clamping the respective opposite edges of the artwork, so that the side of the artwork having the artist's media thereon contacts the spacing means, the base having a respective guide slot formed therein for each of the clamps provided, each of the guide slots being formed extending along a respective axis, each of the adjustable clamps including a respective support block and a respective guide bolt being received through the support block and guide slot therefor, whereby each of the adjustable clamps is guided by the guide bolt disposed through the guide slot for selectively moving the clamps along the respective axes thereof, whereby the position of each of the adjustable clamps is selectively adjustable along respective axes, so that the precise positioning of the respective adjustable clamps may be selectively adjusted, as desired, to accommodate artworks of various sizes and shapes, and such that the support blocks may be positioned abutting opposite edges of the artwork for maintaining the artwork in place on the base, and wherein each of the adjustable clamps includes a respective moveable clamping flange secured to and carried by the support block thereof, so as to be at least partly rotatable relative thereto, whereby with the respective adjustable clamps positioned as desired the clamping flange may be at least partly rotated over the backside of the artwork, such that the artwork is maintained in place on the base for being carried by the device, and at least one stationary clamp positioned along the bottom of the base for providing placement and preventing slippage of the artwork, each stationary clamp further having a thickness, whereby the artwork may be received and supported thereon when the artwork is disposed on the base, a plurality of spaced-apart pins disposed on each of the adjustable clamps and the at least one stationary clamp such that the spaced-apart pins contact the side of the artwork having the artist's media thereon, and a handle formed in the top of the base, whereby the base may be gripped for carrying the device.

* * * * *